US010532834B1

(12) United States Patent
Sanchez

(10) Patent No.: US 10,532,834 B1
(45) Date of Patent: Jan. 14, 2020

(54) COSMETIC FIBER DISPENSER AND FILLER

(71) Applicant: Samuel Arthur Sanchez, McAllen, TX (US)

(72) Inventor: Samuel Arthur Sanchez, McAllen, TX (US)

( * ) Notice: Subject to any disclaimer, the term of this patent is extended or adjusted under 35 U.S.C. 154(b) by 8 days.

(21) Appl. No.: 15/727,478

(22) Filed: Oct. 6, 2017

(51) Int. Cl.
*B65B 1/12* (2006.01)
*B65B 37/10* (2006.01)

(52) U.S. Cl.
CPC ..... *B65B 1/12* (2013.01); *B65B 37/10* (2013.01)

(58) Field of Classification Search
CPC .. B65B 1/10; B65B 1/12; B65B 37/10; B65G 33/00; B65G 33/08; B65G 33/14; B65G 33/24; B65G 33/26; B65G 33/38
USPC ..... 141/256, 258, 259, 260
See application file for complete search history.

(56) References Cited

U.S. PATENT DOCUMENTS 3,381,801 A * 5/1968 Rastoin ..... B65G 33/00 198/659
3,707,224 A * 12/1972 Rastoin ..... B65G 33/00 198/659
3,722,666 A * 3/1973 Ulm ..... B65G 33/24 198/659
4,279,220 A * 7/1981 Kukurba ..... A01K 5/0291 119/51.11
4,291,647 A * 9/1981 Legrain ..... G01F 11/00 119/51.11
4,872,546 A * 10/1989 Hindermann ..... B65G 33/16 198/659
5,082,414 A * 1/1992 Taupin ..... B65G 65/466 198/778
6,427,628 B1 * 8/2002 Reece ..... A01K 5/0291 119/51.11
2018/0141758 A1 * 5/2018 Ross

* cited by examiner

*Primary Examiner* — Timothy L Maust
(74) *Attorney, Agent, or Firm* — Plager Schack LLP; Mark H. Plager; Alexis J. Saenz

(57) ABSTRACT

A cosmetic fiber dispenser and filler apparatus collects cosmetic fibers in a chamber and dispenses fiber into filling tubes by gathering the fiber with a conveyor auger. In an exemplary embodiment, the apparatus includes a wire which is controlled to oscillate within the cosmetic fiber in the chamber to break up clumps as the conveyor auger directs the fiber out an outlet port where it may be dispensed directly into a cosmetics tube.

5 Claims, 3 Drawing Sheets

COSMETIC FIBER DISPENSER AND FILLER

BACKGROUND

The embodiments herein relate generally to cosmetics and more particularly, to a cosmetic fiber dispenser and filler. A recent development in cosmetics is the advent of fiber based make-up. For example, some eyelash mascara can be manufactured from fibers that adhere to eyelashes. The fiber based mascara provides a voluminous effect when applied. However, conventional dispensing/filling methods for fiber cause the fiber to clump up. Thus, current approaches are limited to manual filling of tubes. For example, a small funnel may be placed over the opening of an empty mascara tube and the dry eyelash fiber is plunged into the tube manually, taking about 45 seconds to fill one tube. Dispensing dry eyelash fiber into a mascara container by hand is inefficient since it takes a lot of time (for example, about 45 seconds per tube) to accurately insert the fiber into the tubes without clumping. At 45 seconds per tube, the manual process to dispense dry eyelash fiber into a mascara container is not cost-effective. In addition, refill by hand is currently being done in countries where there is little or inconsistent health regulations. In addition, it may be unsanitary. The possibility of product contamination presents a public health risk; one has little to no control over the day-to-day filling process in a foreign country Embodiments of the disclosed invention solve these problems.

SUMMARY

A cosmetic fiber dispenser and filler apparatus comprises a hopper. A block manifold may be coupled to the hopper and is disposed to receive cosmetic fiber filled into the hopper. The block manifold may include a collection and dispensing chamber and an outlet port in the collection and dispensing chamber. A motor may be coupled to the block manifold. In addition, the apparatus comprises a wire coupled to the motor. The wire is configured to oscillate back and forth within the collection and dispensing chamber when driven by the motor to break up clumps of cosmetic fiber in the block manifold as the cosmetic fiber is directed into the outlet port.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
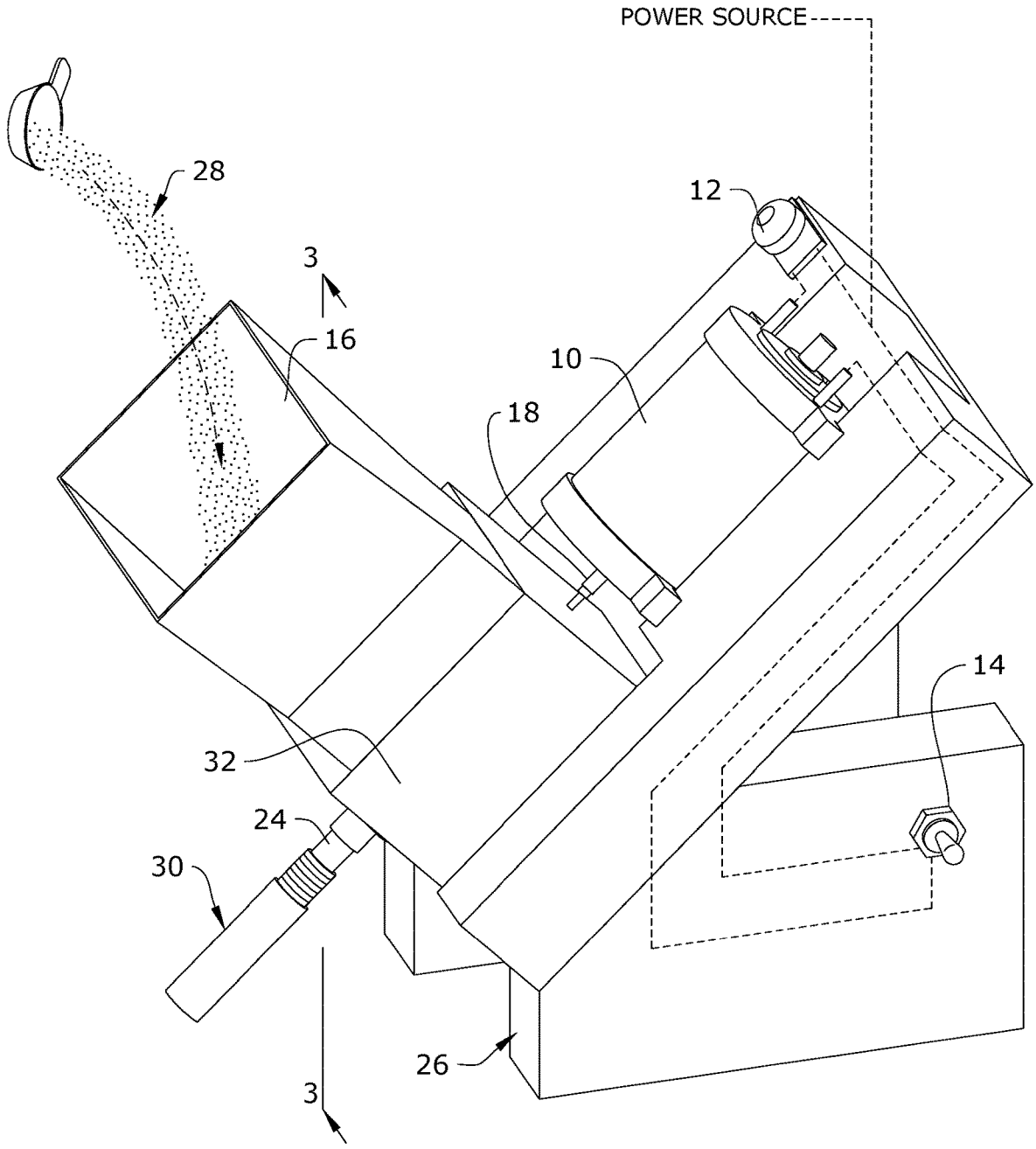
FIG. 1 is a perspective side view of a cosmetic fiber dispenser and filler apparatus positioned at an acute angle from gravity according to an embodiment of the invention.
Figure 2:
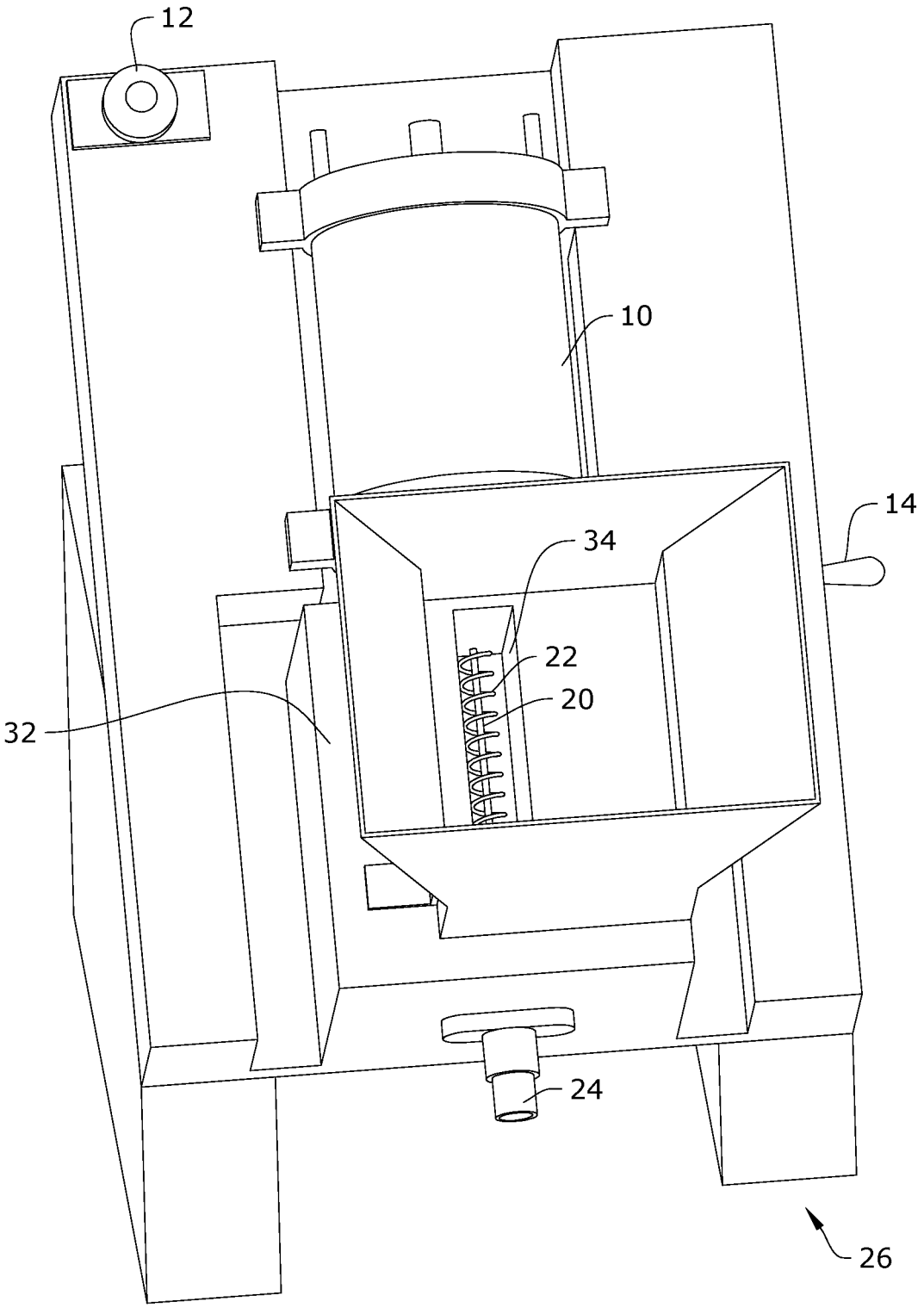
FIG. 2 is a perspective top view of the cosmetic fiber dispenser and filler apparatus of FIG. 1.
Figure 3:
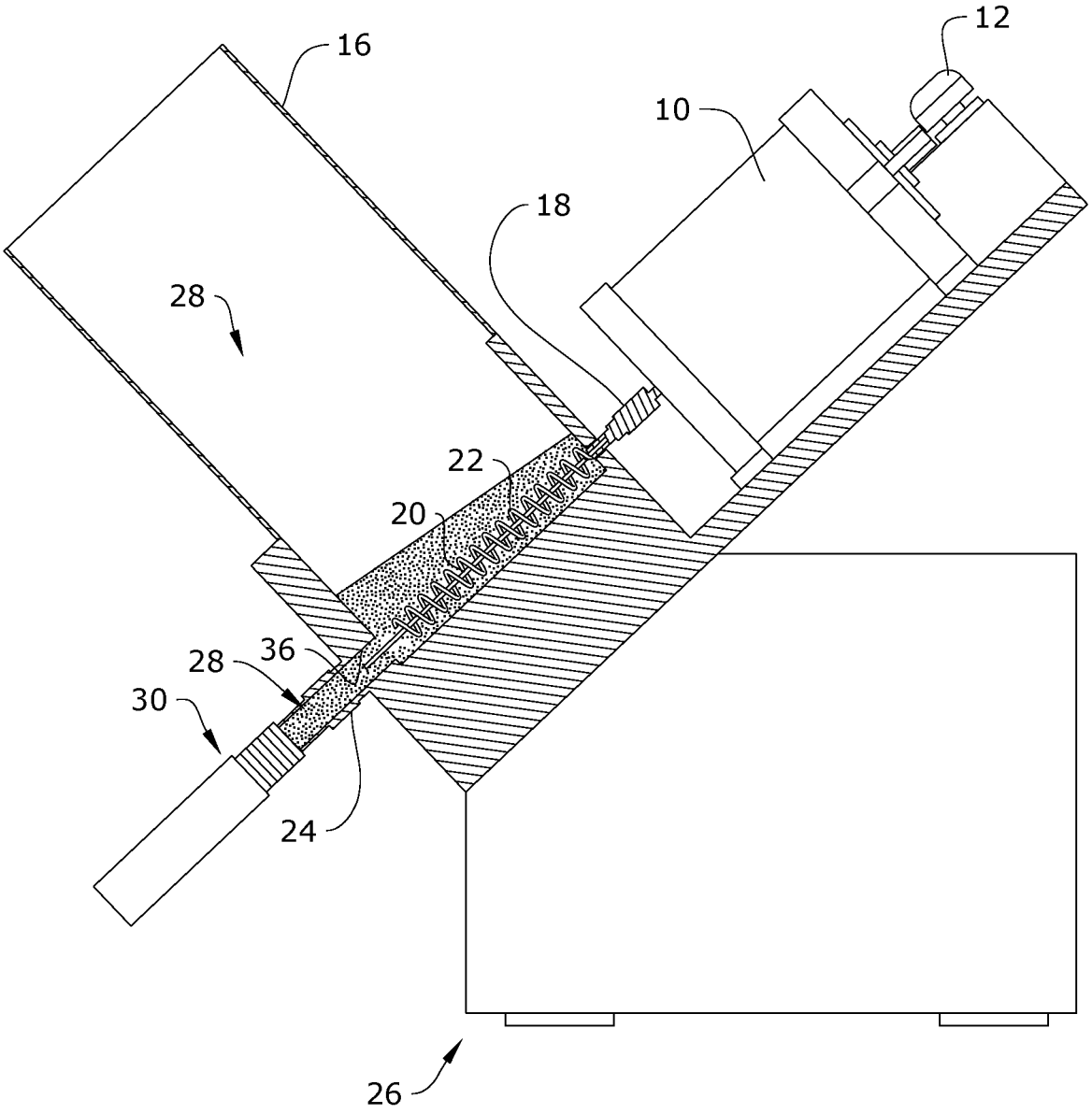
FIG. 3 is a cross-sectional side view of the cosmetic fiber dispenser and filler apparatus of FIG. 1 taken along line 3-3.

By way of example, and referring to FIGS. 1-3, a cosmetic fiber dispenser and filler apparatus is shown in accordance with an embodiment of the subject technology. In general, the cosmetic fiber dispenser and filler apparatus is configured to receive batches of fiber based cosmetic material 28 (sometimes referred to as cosmetic fiber 28 or fiber(s) 28) and dispense the fibers 28 into cosmetic packaging such as tubes 30. Since the fibers 28 are designed to stick to other fibrous materials, for example, eyelashes, the fibers 28 tend to clump to each other. When poured into prior art apparatuses, the fibers 28 may already be clumped (or start to clump together) and are merely pushed in clumps thus clogging the prior art device outlets. Aspects of the cosmetic fiber dispenser and filler apparatus of the subject technology alleviate this problem by including for example, a wire 20 that is driven to break up clumps of fiber 28 before the fiber 28 is directed out into for example, the cosmetic tubes 30 positioned for filling.

The cosmetic fiber dispenser and filler apparatus may include a base 26 supporting, for example, a funnel hopper 16 which may include or is coupled to a block manifold 32. The block manifold 32 may be positioned below the bottom of the funnel hopper 16. At the bottom of the block manifold 32, there may be an opening leading to an underlying collection and dispensing chamber 34 into which the cosmetic fiber 28 is gathered for processing (breaking up any clumps). An outlet port 36 (FIG. 3) may be on one end of the collection and dispensing chamber 34. The block manifold 32 may be angled (for example, at 45°) with respect to gravity so that gravity may assist movement of the fiber 28 through the outlet port 36. On an opposing side of the collection and dispensing chamber 34, a shaft assembly 18 (driven by a motor 10), may be coupled to the wire 20. An on/off switch 14 controls power provided to the motor 10. Some embodiments may include a variable speed switch 12 controlling how fast elements connected to the motor 10 are driven.

The wire 20 may traverse the length of the collection and dispensing chamber 34 or block manifold 32. In an exemplary embodiment, the wire 20 is long and thin and driven so that it oscillates. The frequency/amplitude of oscillation may be controlled via the switch 12. The oscillating action of the wire 20 when driven by the motor 10 breaks up any clumps as the fiber 28 is directed out of the block manifold 32.

In some embodiments, a conveyor 22 within the collection and dispensing chamber 34 may be coupled to the motor 10 (for example, the conveyor 20 may also be coupled to the shaft assembly 18) and moves the fiber 28 out of the block manifold 32. The conveyor 22 may be an auger type conveyor. In an exemplary embodiment, the conveyor 22 includes an open, coil body. In some embodiments, the wire 20 and conveyor 22 are both attached to the shaft assembly 18.

In an exemplary embodiment, the wire 20 is positioned centered within the auger conveyor 22 so that the coil is concentric about the wire 20 and the wire 20 extends axially from the shaft assembly 18 to the outlet port 36. The thickness of the wire 20 may be much smaller than the inner diameter of the conveyor 22 coils to allow for ample clearance to move back and forth within the coils. In operation, as fiber 28 is introduced through the hopper 16 and into the block manifold 32, the motor 10 may drive the auger conveyor 22 to move spirally. Fiber 28 encountering the auger conveyor 22 may follow gravity toward the outlet port 36. As the shaft assembly 18 is driven by the motor 10, both the wire 20 and conveyor 22 spin together. The rotation of the shaft assembly 18 may also apply a centrifugal force to the wire 20 driving the wire 20 in an oscillating motion causing the wire 20 to move back and forth, sometimes flexing in a whipping action within the inner diameter of the coil body of the auger conveyor 22. Any fiber 28 that clumps together is broken up by the movement of the wire 20 thus releasing the stuck fibers for travel. In some embodiments, a nozzle 24 connected to the outlet 36 extends outward from the block manifold 32. In operation, a user may pour an amount of fiber 28 that is equivalent to an amount filling the volume (or nearly full volume) of cosmetic tube 30. Depending on the viscosity of the fiber 28, the variable speed switch 12 may be adjusted to increase/decrease the action of the wire 20 to provide a continuous flow of fiber 28. Thus, as may be appreciated, the process of filling individual tubes 30 is greatly sped up and improved on by automatically breaking up clumped fiber 28 and automatically filling a tube 30 attached to the nozzle 24. For example, what used to take up to several minutes by the manual insertion of fiber into a tube is now performed by the embodiments disclosed here in three seconds. In another exemplary operation, one may also forgo attaching the tube 30 to the apparatus and may pour an arbitrary amount of cosmetic fiber 28 into the hopper 16, for the continuous un-clumped content thereof being dispensed out the nozzle 24.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A cosmetic fiber dispenser and filler apparatus, comprising:

a hopper;

a block manifold coupled to the hopper disposed to receive cosmetic fiber filled into the hopper;

a collection and dispensing chamber in the block manifold;

an outlet port in the collection and dispensing chamber of the block manifold;

a motor coupled to the block manifold;

a wire coupled to the motor and positioned in the collection and dispensing chamber, wherein the wire is configured to flexibly whip back and forth within the collection and dispensing chamber when driven by the motor to break up clumps of cosmetic fiber in the block manifold as the cosmetic fiber is directed into the outlet port; and a nozzle on an end of the outlet port configured to receive a cosmetics tube and to dispense un-clumped cosmetic fiber from the block manifold into the cosmetics tube.

2. The cosmetic fiber dispenser and filler apparatus of claim 1, further comprising an auger conveyor coil in the collection and dispensing chamber, wherein the auger conveyor coil is configured to direct the cosmetic fiber into the outlet port when driven by the motor.

3. The cosmetic fiber dispenser and filler apparatus of claim 2, wherein the auger conveyor coil is aligned with the outlet port.

4. The cosmetic fiber dispenser and filler apparatus of claim 3, wherein the wire is positioned concentrically and axially within the auger conveyor coil.

5. The cosmetic fiber dispenser and filler apparatus of claim 1, wherein the block manifold is positioned at an angle greater than zero degrees from a vector that is perpendicular to gravity.

* * * * *